US008333464B2

(12) United States Patent
Hirato

(10) Patent No.: US 8,333,464 B2
(45) Date of Patent: Dec. 18, 2012

(54) LIQUID APPLICATION APPARATUS, LIQUID APPLICATION METHOD AND IMAGE FORMING APPARATUS

(75) Inventor: Katsuyuki Hirato, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 508 days.

(21) Appl. No.: 12/554,286

(22) Filed: Sep. 4, 2009

(65) Prior Publication Data

US 2010/0060688 A1 Mar. 11, 2010

(30) Foreign Application Priority Data

Sep. 5, 2008 (JP) ..... 2008-228290

(51) Int. Cl.
*B41J 2/01* (2006.01)

(52) U.S. Cl. ..... 347/96; 347/98; 347/100; 347/103; 118/46

(58) Field of Classification Search ..... 347/102, 347/103, 95–100; 118/46, 48
See application file for complete search history.

(56) References Cited

U.S. PATENT DOCUMENTS 4,432,003 A * 2/1984 Barbero et al. ..... 347/55
5,367,982 A * 11/1994 DeMoore et al. ..... 118/46
6,059,407 A * 5/2000 Komatsu et al. ..... 347/103
7,270,409 B2 * 9/2007 Iwasaki et al. ..... 347/103
2005/0200666 A1 9/2005 Iwasaki et al.
2009/0235863 A1 * 9/2009 Takatsuka ..... 118/258

FOREIGN PATENT DOCUMENTS

JP 6-246902 A 9/1994
JP 9-192557 A 7/1997
JP 2005-254809 A 9/2005
JP 2007-117807 A 5/2007

OTHER PUBLICATIONS

Japanese Office Action dated Oct. 10, 2012, issued in corresponding Japanese Patent Application No. 2008-228290 (English translation is provided).

* cited by examiner

*Primary Examiner* — Matthew Luu
*Assistant Examiner* — Rut Patel
(74) *Attorney, Agent, or Firm* — Birch, Stewart, Kolasch & Birch, LLP

(57) ABSTRACT

A liquid application apparatus includes: an application member which applies a first liquid to a recording medium; and a liquid holding member which abuts against the application member so as to form a liquid holding space in which the first liquid is held in such a manner that the first liquid held in the liquid holding space is applied to the recording medium via the application member by rotating the application member, wherein a supply port for supplying the first liquid in the liquid holding space and a recovery port for recovering the first liquid from the liquid holding space are provided in the liquid holding member, and the supply port and the recovery port are located in different positions in terms of vertical direction.

12 Claims, 16 Drawing Sheets

LIQUID APPLICATION APPARATUS, LIQUID APPLICATION METHOD AND IMAGE FORMING APPARATUS

BACKGROUND OF THE INVENTION

1. Field of the Invention

The present invention relates to a liquid application apparatus, a liquid application method and an image forming apparatus, and more particularly to liquid application technology that can be used desirably for depositing a treatment liquid on a recording medium prior to the deposition of an ink by means of an inkjet recording apparatus in order to promote aggregation of a color material of the ink, for example.

2. Description of the Related Art

In order to realize a high quality printing by an inkjet recording apparatus, the technology is known in which a treatment liquid, such as multivalent metal salt solution or acid aqueous solution, is deposited on a recording medium prior to depositing an ink thereon, so that the treatment liquid reacts with the ink on the recording medium so as to prevent the breeding or color mixture of the ink.

Japanese Patent Application Publication No. 2005-254809 discloses a liquid application apparatus comprising: a mechanism depositing a treatment liquid on a recording medium. The mechanism includes: an application roller serving as an application member applying the treatment liquid to the recording medium; and a liquid holding member holding the treatment liquid in a liquid holding space which is formed by causing the liquid holding member to abut against the surface (roller surface) of the application roller. According to this liquid application apparatus, by rotating the application roller, the treatment liquid held in the liquid holding space is applied to the recording medium by means of the application roller.

Here, structure of the liquid application apparatus disclosed in Japanese Patent Application Publication No. 2005-254809 is described with reference to FIGS. 13 and 14. FIG. 13 is a cross-sectional view illustrating the main structure of a general liquid application apparatus. FIG. 14 is a plan view illustrating a liquid holding member included in the liquid application apparatus illustrated in FIG. 13.

The general liquid application apparatus 900 illustrated in FIG. 13 comprises an application roller 950, a counter roller 952 opposite to the application roller 950, a liquid holding member 954 holding a treatment liquid in a liquid holding space S formed by abutting against the circumferential surface of the application roller 950.

The liquid holding member 954 is constituted by a space forming base member 955 and a circular abutment member 956 which is provided on and projects from one surface of the space forming base member 955. Further, a spring member 940 is provided on the rear side of the liquid holding member 954 so that the liquid holding member 954 is impelled toward the circumferential surface of the application roller 950 by means of the impelling force of the spring member 940. According to this structure, in a state where the abutment member 956 of the liquid holding member 954 is pressed against and abuts against (closely contact with) the circumferential surface of the application roller 950, the blocked (sealed) liquid holding space S is formed by the abutment member 956, one surface of the space forming base member 955 and the circumferential surface of the application roller 950.

Further, as illustrated in FIG. 14, in the liquid holding member 954, a liquid supply port 958 and a liquid recovery port 959 which is formed so as to pierce the space forming base member 955 are provided within the region enclosed by the abutment member 956. During performing printing (in other words, during the application operation), while a treatment liquid is supplied from a liquid supply device (not illustrated) to the liquid holding space S via the liquid supply port 958, the treatment liquid is flown out from the liquid recovery port 959, thereby performing the circulation of the treatment liquid in the liquid holding space S.

Then, by rotating the application roller 950 in a clockwise direction in terms of FIG. 13, while a recording medium 912 nipped and supported by both the rollers 950 and 952 is conveyed, the treatment liquid deposited on the circumferential surface of the application roller 950 is transferred onto the recording surface of the recording medium 912.

Further, in this liquid application apparatus 900, when it is determined that an application operation is not carried out during some time after the end of the previous application operation, the recovery operation of the treatment liquid is carried out with respect to the liquid holding space S, so that the evaporation of the application liquid (treatment liquid) in the liquid holding member 954 due to being left for a long time is reduced and the immersion of the application roller 950 into the application liquid is avoided, thereby restraining degradation of the application roller 950 caused by the application liquid.

However, in the above-described general liquid application apparatus 900, as illustrated in FIG. 15, an air bubble Q is liable to stay in the ceiling part (the upper part in the vertical direction) of the liquid holding space S when the air bubble Q enters the liquid holding space S, which may tends to develop application failure.

Further, as for the recovery operation of the treatment liquid in the liquid holding space S, as illustrated in FIG. 16, the treatment liquid tends to remain in the bottom part (the bottom part in the vertical direction) of the liquid holding space S, which may tends to develop the drying and leakage of the remaining liquid (treatment liquid).

SUMMARY OF THE INVENTION

The present invention has been contrived in view of these circumstances, an object thereof being to provide a liquid application apparatus, a liquid application method and an image forming apparatus which can fix failures caused by air bubbles or remaining liquid in a liquid holding space in order to improve the application stability.

In order to attain an object described above, one aspect of the present invention is directed to a liquid application apparatus comprising: an application member which applies a first liquid to a recording medium; and a liquid holding member which abuts against the application member so as to form a liquid holding space in which the first liquid is held in such a manner that the first liquid held in the liquid holding space is applied to the recording medium via the application member by rotating the application member, wherein a supply port for supplying the first liquid in the liquid holding space and a recovery port for recovering the first liquid from the liquid holding space are provided in the liquid holding member, and the supply port and the recovery port are located in different positions in terms of vertical direction.

According to this aspect of the invention, by arranging the recovery port above the supply port in terms of the vertical direction, air bubbles included in the liquid holding space can be discharged via the recovery port. Further, by arranging the recovery port below the supply port in terms of the vertical direction, the liquid in the liquid holding space can be recovered via the recovery port. In other words, by arranging the recovery port and the supply port in different positions in terms of the vertical direction, it is possible to discharge air bubbles included in the liquid holding space and to recover the liquid in the liquid holding space. As a result, application failures due to the air bubbles, and drying and leakage of the remaining liquid, can be prevented, thereby improving the application stability performance with respect to a recording medium.

The "recording medium" collectively means media which the application of a treatment liquid is subject to, and can represent printing media, media on which an image is formed, media on which recording is performed, media on which a picture/image is received, media on which ejection is received and intermediate transfer bodies. The shape and material of the medium is not limited in particular, and the recording medium can represent, regardless of the material or shape thereof, a variety of media, such as continuous papers, cut papers, sealed papers, sticker sheets, resin sheets for overhead projectors or the like, films, cloths, printed circuit boards on which wiring pattern or the like can be formed, rubber sheets and metal sheets.

Desirably, the recovery port is arranged above the supply port in terms of the vertical direction.

Desirably, a bubble trap part is provided in the liquid holding space so as to extend above a contact surface between the application member and the liquid holding space in terms of the vertical direction, and the recovery port is connected to the bubble trap part.

Desirably, the recovery port is provided below the supply port in terms of the vertical direction.

Desirably, a remaining liquid trap part is provided in the liquid holding space so as to extend below a contact surface between the application member and the liquid holding space in terms of the vertical direction, and the recovery port is connected to the remaining liquid trap part.

Desirably, in the liquid holding member, a first recovery port is provided above the supply port in terms of the vertical direction and a second recovery port is provided below the supply port in terms of the vertical direction.

Desirably, in the liquid holding space, a bubble trap part is provided so as to extend above a contact surface between the application member and the liquid holding space in terms of the vertical direction and a remaining liquid trap part is provided so as to extend below a contact surface between the application member and the liquid holding space in terms of the vertical direction; and the first recovery port is connected to the bubble trap part and the second recovery port is connected to the remaining liquid trap part.

Desirably, the liquid application apparatus comprises: a liquid storing device which stores the first liquid recovered from the liquid holding space; a first recovery flow channel connected to the first recovery port; a second recovery flow channel connected to the second recovery port; a third recovery flow channel connected to the liquid storing device; and a flow channel switching device which is connected to the first to third recovery flow channels and selectively switches between a state where the first recovery flow channel is connected to the third recovery flow channel and a state where the second recovery flow channel is connected to the third recovery flow channel.

Desirably, the liquid application apparatus comprises a first controller which controls the flow channel switching device in such a manner that the first recovery flow channel is connected to the third recovery flow channel while the application member applies the first liquid to the recording medium.

Desirably, the liquid application apparatus comprises a second controller which controls the flow channel switching device in such a manner that, when a liquid filling operation in which the liquid holding space is filled with the first liquid is carried out, the first recovery flow channel is connected to the third recovery flow channel at least in a final stage of the liquid filling operation.

Desirably, the liquid application apparatus comprises a third controller which controls the flow channel switching device in such a manner that, when a liquid recovery operation in which the first liquid is recovered from the liquid holding space is carried out, the second recovery flow channel is connected to the third recovery flow channel at least in a final stage of the liquid recovery operation.

Another aspect of the present invention is directed to an image forming apparatus comprising: one of the above-described liquid application apparatuses; and a liquid ejection device which ejects a second liquid onto the recording medium to which the liquid application device has applied the first liquid.

The "image forming apparatus" is not in particular limited to devices for the so-called graphic printing such as a photo printing or poster printing, and collectively means devices which include industry application devices that can form patterns which can be classified as images, such as resist printing apparatuses, wiring forming apparatuses for electronic circuit substrates and apparatuses that form fine structural objects, for example.

Desirably, the second liquid is an ink containing a color material, and the first liquid is a treatment liquid having a property of aggregating the color material.

According to this aspect of the invention, the accuracy of the application volume of the treatment liquid with respect to a recording medium can be improved, and image failures due to the non-uniformity of application or the like can be prevented, and thereby a high-quality image can be formed.

Another aspect of the present invention is directed to a liquid application method using a liquid application apparatus, wherein the liquid application apparatus includes: an application member which applies a first liquid to a recording medium; a liquid holding member which abuts against the application member so as to form a liquid holding space in which the first liquid is held in such a manner that the first liquid held in the liquid holding space is applied to the recording medium via the application member by rotating the application member; a supply port which is provided in the liquid holding member and supplies the first liquid in the liquid holding space, and a first recovery port and a second recovery port which are provided in the liquid holding member and recover the first liquid from the liquid holding space, the supply port and the recovery port being located in different positions in terms of vertical direction; a liquid storing device which stores the first liquid recovered from the liquid holding space; a first recovery flow channel connected to the first recovery port; a second recovery flow channel connected to the second recovery port; a third recovery flow channel connected to the liquid storing device; and a flow channel switching device which is connected to the first to third recovery flow channels and selectively switches between a state where the first recovery flow channel is connected to the third recovery flow channel and a state where the second recovery flow channel is connected to the third recovery flow channel, wherein the liquid application method comprising the step of applying the first liquid to the recording medium by the application member, and wherein, while the application member applies the first liquid to the recording medium, the flow channel switching device maintains the state where the first recovery flow channel is connected to the third recovery flow channel.

Desirably, when a liquid filling operation in which the liquid holding space is filled with the first liquid is carried out, the first recovery flow channel is connected to the third recovery flow channel at least in a final stage of the liquid filling operation.

Desirably, when a liquid recovery operation in which the first liquid is recovered from the liquid holding space is carried out, the second recovery flow channel is connected to the third recovery flow channel at least in a final stage of the liquid recovery operation.

According to the invention, by arranging the recovery port above the supply port in terms of the vertical direction, air bubbles included in the liquid holding space can be discharged via the recovery port. Further, by arranging the recovery port below the supply port in terms of the vertical direction, the liquid in the liquid holding space can be recovered via the recovery port. In other words, by arranging the recovery port and the supply port in different positions in terms of the vertical direction, it is possible to discharge air bubbles included in the liquid holding space and to recover the liquid in the liquid holding space. As a result, application failures due to the air bubbles, and drying and leakage of the remaining liquid, can be prevented, thereby improving the application stability performance with respect to a recording medium.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein.

DETAILED DESCRIPTION OF THE PREFERRED EMBODIMENTS

General Structure of Inkjet Recording Apparatus

Firstly, an inkjet recording apparatus which is one embodiment of an image forming apparatus relating to the present invention will be described.

Figure 1:
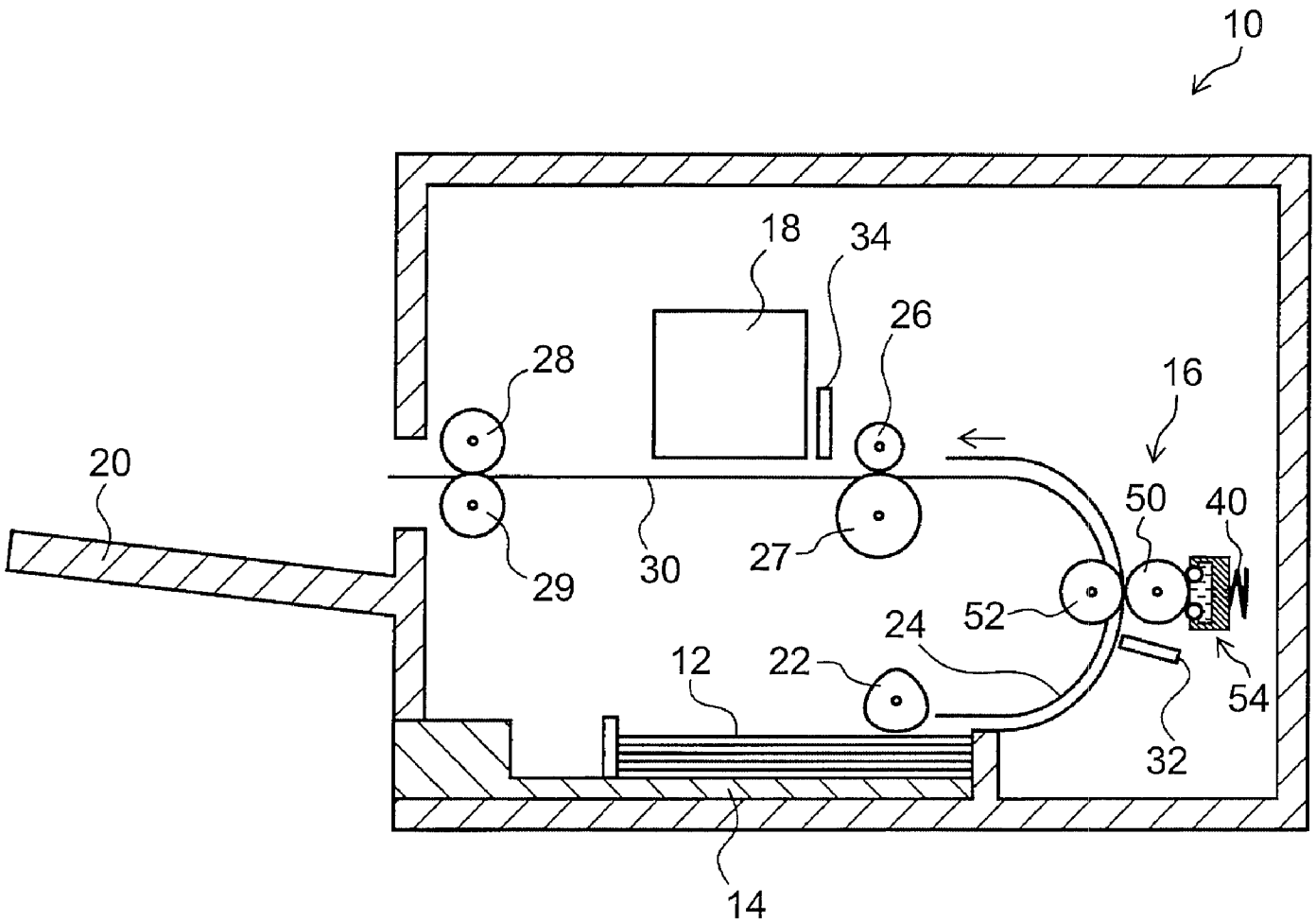
FIG. 1 is a general schematic drawing illustrating an approximate view of an inkjet recording apparatus relating to one embodiment of the present invention.

FIG. 1 is a schematic drawing illustrating an overview of an inkjet recording apparatus relating to the present embodiment. As illustrated in FIG. 1, the inkjet recording apparatus 10 comprises: a paper supply unit 14 which supplies a recording medium 12; a treatment liquid application unit 16 which applies treatment liquid to the recording medium 12 supplied from the paper supply unit 14; an ink droplet ejection unit 18 which ejects droplets of ink onto the recording medium 12 after the deposition of treatment liquid; and an output tray 20 which outputs the recording medium 12 onto which an image has been formed by the ink droplet ejection unit 18.

The paper supply unit 14 employs a method based on a paper supply cassette in which a plurality of sheets of recording media 12 cut to a prescribed size are loaded. It is also possible to provide a plurality of paper supply cassettes in such a manner that papers of a plurality of different sizes can be supplied. Furthermore, it is also possible to adopt a mode in which rolled paper (continuous paper) is used instead of cut sheet, and the rolled paper is cut to an appropriate size by a cutter.

The treatment liquid application unit 16 comprises a treatment liquid application device which applies treatment liquid to a recording medium 12, and a treatment liquid supply device which supplies the treatment liquid to the treatment liquid application device.

The treatment liquid application device is constituted by a round cylindrical application roller 50 forming an application member, a round cylindrical counter roller (medium supporting member) 52 which is disposed so as to oppose the application roller 50, and a roller drive mechanism (not illustrated) which drives the application roller 50, and the like. The application roller 50 and the counter roller 52 are respectively supported rotatably by mutually parallel axes of which the respective ends are installed rotatably on a frame (not illustrated).

The counter roller 52 is impelled toward the circumferential surface of the application roller 50 by means of an impelling device (not illustrated), and by rotating the application roller 50 in the clockwise direction in FIG. 1, the recording medium 12 onto which the treatment liquid is to be applied is conveyed in the direction indicated by the arrow while the recording medium 12 is sandwiched and supported between both the application roller 50 and the counter roller 52.

The treatment liquid supply device comprises: a liquid holding member 54 which holds the treatment liquid between the liquid holding member 54 and the circumferential surface of the application roller 50, and a liquid supply apparatus (not illustrated) which supplies the treatment liquid to the liquid holding member 54. The liquid holding member 54 extends through the lengthwise direction of the application roller 50 and is installed movably on the aforementioned frame via a mechanism which enables separation from the circumferential surface of the application roller 50.

The ink droplet ejection unit 18 is provided on the downstream side of the treatment liquid application unit 16 in terms of the direction of conveyance of the medium. The ink droplet ejection unit 18 according to the present example is constituted by recording heads of an inkjet type which correspond respectively to inks of four colors of yellow (Y), magenta (M), cyan (C) and black (K). Although not illustrated in the drawings, inks of the corresponding colors are supplied respectively to the recording heads of the respective colors, from ink tanks which are not illustrated.

The recording heads of the respective colors in the ink droplet ejection unit 18 are each heads of a full line type which respectively have a length corresponding to the maximum width of the image forming region on the recording medium 12 and comprise a plurality of ink ejection nozzles arranged through the full width of the image forming region on the ink ejection surface of the head.

The recording heads of the respective colors are fixed so as to extend in a direction perpendicular to the direction of conveyance of the recording medium 12 (the direction perpendicular to the plane of the drawing in FIG. 1), and respectively eject liquid droplets of the corresponding colored ink onto the recording medium 12 on the platen 30.

In this way, according to a composition in which full line heads having nozzle rows covering the full width of the image forming region of the recording medium 12 are provided for each color of ink, it is possible to record an image on the image forming region of the recording medium 12 by performing just one operation of moving the recording medium 12 and the recording head relatively with respect to each other in the direction of conveyance of the recording medium 12 (the sub-scanning direction), in other words, by performing just one sub-scanning.

It is also possible to adopt a mode which employs, instead of full line heads, heads of a serial (shuttle) type which move reciprocally back and forth in a direction (main scanning direction) perpendicular to the direction of conveyance of the recording medium 12 (sub-scanning direction), but forming an image by a single pass method using heads of a full line type (page-wide heads) enables faster printing than a multi-pass method using serial (shuttle) type heads, and therefore the print productivity can be improved.

Although the configuration with the CMYK four colors is described in the present embodiment, combinations of the ink colors and the number of colors are not limited to those. Light inks, dark inks or special color inks can be added as required. For example, a configuration is possible in which recording heads for ejecting light-colored inks such as light cyan and light magenta are added. Furthermore, there are no particular restrictions of the sequence in which the heads of respective colors are arranged.

Possible examples of the ink used in the inkjet recording apparatus 10 according to the present embodiment include a dye-based ink in which a coloring material is dissolved in a molecular state (an ionic state is also possible) in the solvent of the liquid, and a pigment-based ink in which a coloring material is dispersed in the solvent of the liquid in a state of small particles.

On the other hand, the treatment liquid is a liquid which generates an aggregate of the coloring material when mixed with an ink. Specific examples of the treatment liquid include a treatment liquid which precipitates or insolubilizes the coloring material in the ink by reacting with the ink, and a treatment liquid which generates a semi-solid material (gel) that includes the coloring material in the ink, and the like.

The means of generating a reaction between the ink and the treatment liquid may be a method which causes an anionic coloring material in the ink with a cationic compound in the treatment liquid, a method which aggregates pigment by breaking down the dispersion of the pigment in the ink due to altering the pH of the ink by mixing an ink and a treatment liquid which have different pH values, a method which aggregates pigment by breaking down the dispersion of the pigment in the ink due to a reaction with a polyvalent metal salt in the treatment liquid, or the like.

For instance, examples of a treatment liquid having an action of aggregating the coloring material contained in ink which is ejected as droplets from the ink droplet ejection unit 18 according to the present embodiment are aggregating treatment agents, such as a polyvalent metal salt, polyallylamine, a polyallylamine derivative, an acidic liquid, a cationic surfactant, and the like. By promoting the aggregation of the coloring material on the recording medium 12 by means of a treatment liquid of this kind, it is possible to improve the recording density as well as reducing or preventing bleeding.

According to this composition, recording media 12 which are loaded in the paper supply unit 14 are supplied to the conveyance path 24 repeatedly, one sheet at a time, by the paper supply roller 22. When a recording medium 12 which has been supplied to the conveyance path 24 from the paper supply unit 14 is fed between the rollers 50 and 52, then the treatment liquid is applied to the recording surface of the recording medium 12 while the application roller 50 is rotated in the clockwise direction in FIG. 1 by the roller drive mechanism and thereby conveys the recording medium 12.

The recording medium 12 onto which the treatment liquid has been applied is conveyed onto a platen 30 by a pair of conveyance rollers 26, 27, moved to a position opposing the ink droplet ejection unit 18, and ink droplets are ejected onto the recording surface of the recording medium 12 from the nozzles of the recording head.

The recording medium 12 on which an image has been formed in this way is output to an output tray 20 by a pair of output rollers 28 and 29.

Medium leading edge determination sensors 32 and 34 which determine the leading edge of the recording medium 12 are disposed in the conveyance path 24 for the recording medium 12. The first medium leading edge determination sensor 32 is disposed in the vicinity of the input to the application roller 50 on the paper supply side. The second medium leading edge determination sensor 34 is disposed in the vicinity of the input to the ink droplet ejection unit 18 on the paper supply side.

The treatment liquid application timing and the ink droplet ejection timing are controlled by determining the position of the recording medium 12 by means of these sensors (32, 34).

Structure of Treatment Liquid Application Apparatus

Next, configuration examples (first to fifth embodiments) of a liquid application apparatus (treatment liquid application unit 16) to which embodiments of the present invention is applied are described with reference to FIGS. 2 to 8.

First Embodiment

Figure 2:
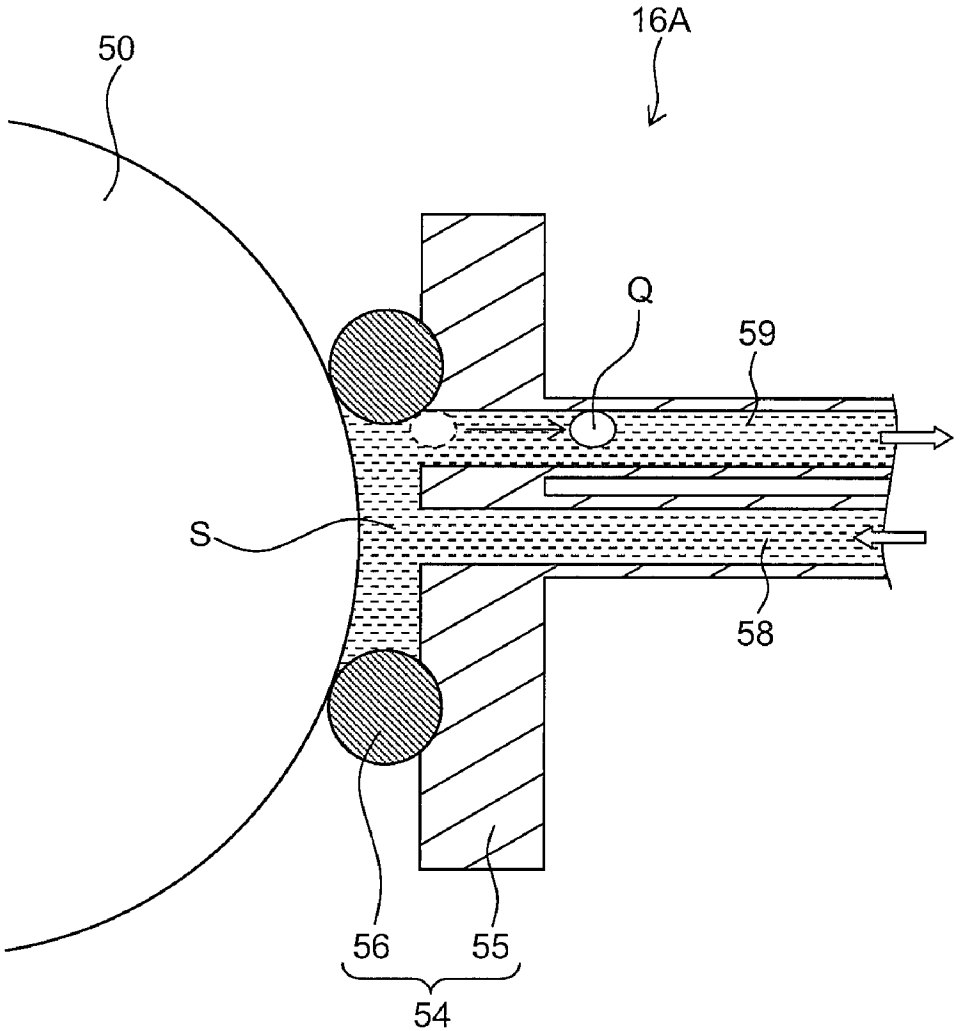
FIG. 2 is a cross-sectional diagram illustrating main components of a treatment liquid application unit related to a first embodiment.

FIG. 2 is a cross-sectional diagram illustrating main components of the treatment liquid application unit 16A related to a first embodiment. As illustrated in FIG. 2, the treatment liquid application unit 16A includes a liquid holding member 54 which holds the treatment liquid in a liquid holding space S formed by causing the liquid holding member 54 to abut against the application roller 50.

This liquid holding member 54 includes a space forming base member 55 and a circular abutment member 56 which is provided on and projects from one surface of the space forming base member 55. Furthermore, a spring member 40 (see FIG. 1) is provided on the rear surface side of the liquid holding member 54 which constitutes the liquid supply device, and the liquid holding member 54 is impelled toward the circumferential surface of the application roller 50 by the impelling force of the spring member 40. The liquid holding member 54 is constituted by a space forming base member 55, and a ring-shaped abutting member 56 which is provided in a projecting manner on one surface of the space forming base member 55. By this means, in a state where the abutting member 56 of the liquid holding member 54 is abutted (in tight contact) so as to press against the circumferential surface of the application roller 50, a liquid holding space S is formed which is sealed off (hermetically closed) by the abutting member 56, one surface of the space forming base member 55, and the circumferential surface of the application roller 50.

Further, in the liquid holding member 54, a liquid supply port 58 and a liquid recovery port 59 are provided in so as to pass through the space forming base member 55, and the liquid recovery port 59 is located above the liquid recovery port 59 in terms of the vertical direction. For convenience of description, FIG. 2 illustrates one example of the structure where one liquid supply port 58 and one liquid recovery port 59 are provided by an example, but it is not limited to the present example, and a plurality of liquid supply ports 58 may be provided and a plurality of liquid recovery ports 59 may be provided.

During the printing operation (in other words, during the application operation), by causing a flow of the treatment liquid from the liquid recovery port while supplying the treatment liquid to the liquid holding space S from the liquid supply port 58, the circulation of the treatment liquid in the liquid holding space S is carried out.

According to the first embodiment, the liquid recovery port 59 is arranged above the liquid supply port 58 in terms of the vertical direction, and therefore even if air bubbles enter the inside of the liquid holding space S, it is easy to discharge such air bubbles via the liquid recovery port 59 along with the circulation of the treatment liquid.

Second Embodiment

Figure 3:
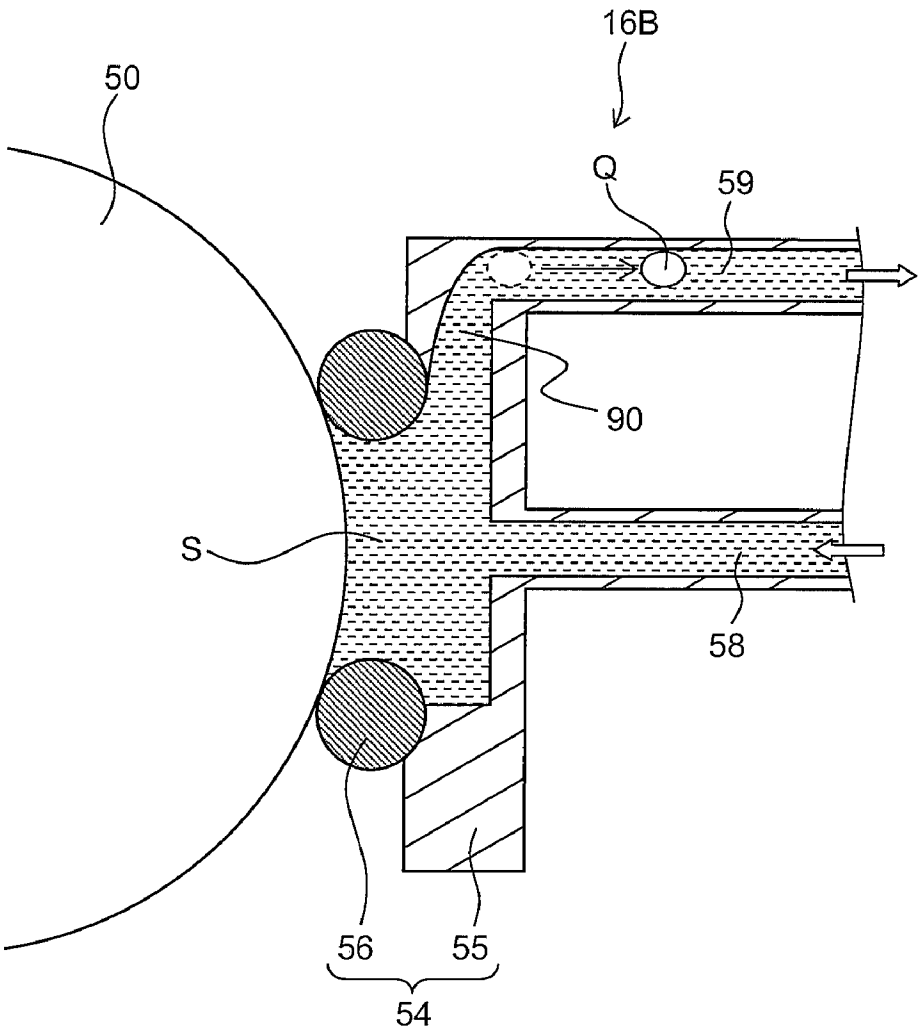
FIG. 3 is a cross-sectional diagram illustrating main components of a treatment liquid application unit related to a second embodiment.

FIG. 3 is a cross-sectional diagram illustrating main components of the treatment liquid application unit 16B related to a second embodiment. The elements that are common to the devices illustrated in FIGS. 2 and 3 are assigned to the same numbers, and the description thereof is omitted here.

As is the case of the first embodiment described above, in the treatment liquid application unit 16B related to the second embodiment, the liquid recovery port 59 is arranged above the liquid supply port 58 in terms of the vertical direction as illustrated in FIG. 3.

Further, in the second embodiment, an air bubble trap part 90 is provided so as to project upward in terms of the vertical direction beyond the contact surface with the application roller 50 on the rear side of the liquid holding space S (on the opposite side of the liquid holding space S from the application roller 50), and is connected to the liquid recovery port 59.

In the second embodiment, an air bubble Q entering the liquid holding space S is collected in the air bubble trap part 90 formed so as to project upward in terms of the vertical direction beyond the contact surface with the application roller 50. According to this structure, an air bubble existing in the vicinity of the upper end portion of the contact surface with the application roller 50 can be discharged via the liquid recovery port 59, thereby improving the discharge performance of air bubbles more effectively, compared to the first embodiment.

Third Embodiment

Figure 4:
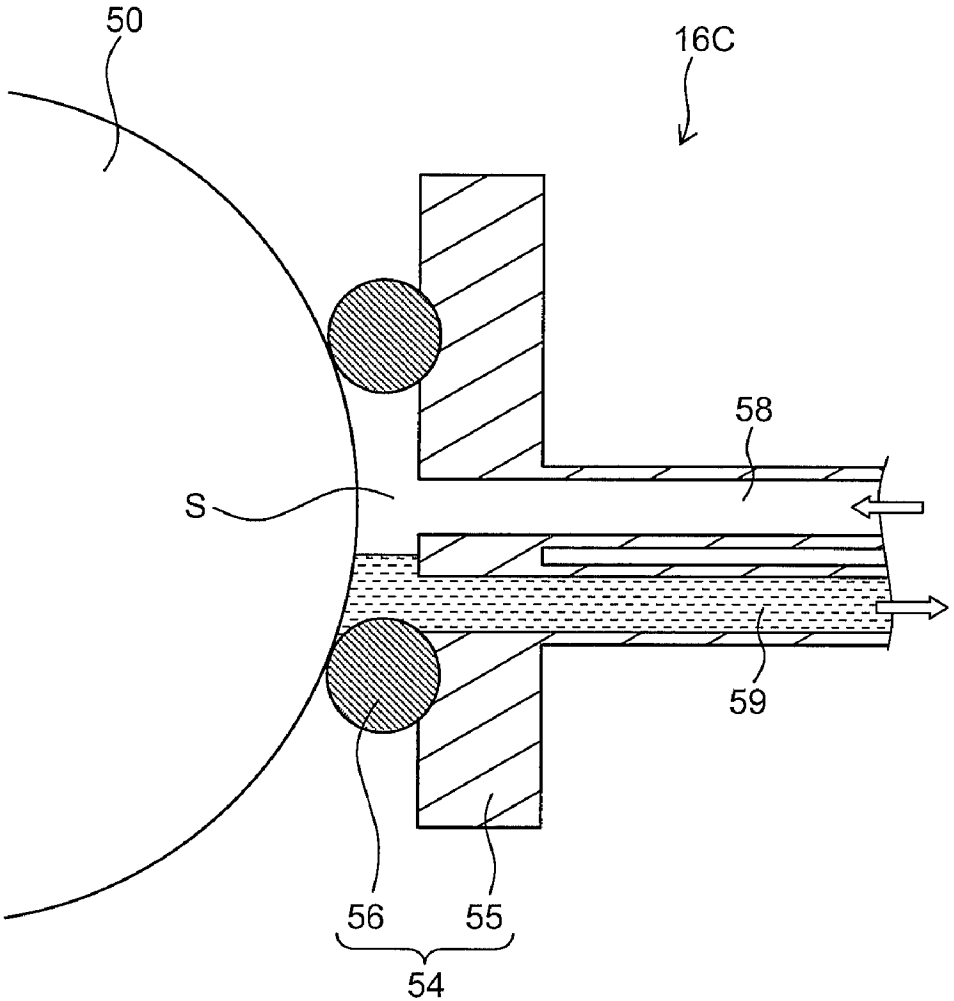
FIG. 4 is a cross-sectional diagram illustrating main components of a treatment liquid application unit related to a third embodiment.

FIG. 4 is a cross-sectional diagram illustrating main components of the treatment liquid application unit 16C related to a third embodiment. The elements that are common to the devices illustrated in FIGS. 2 and 3 are assigned to the same numbers, and the description thereof is omitted here.

As illustrated in FIG. 4, the treatment liquid application unit 16C related to the third embodiment has similar structure to the treatment liquid application unit 16A related to the first embodiment illustrated in FIG. 2, except for the liquid recovery port 59 being arranged below the liquid supply port 58 in terms of the vertical direction.

Figure 5:
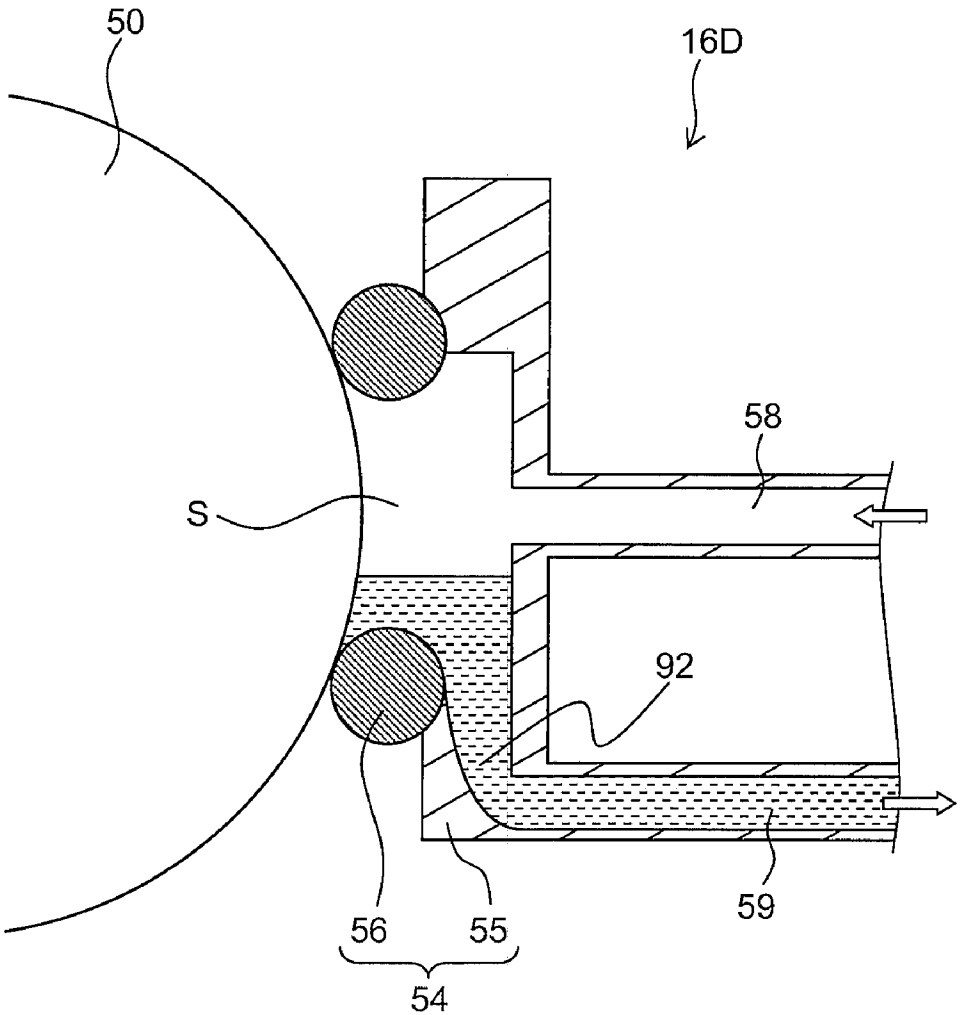
FIG. 5 is a cross-sectional diagram illustrating main components of a treatment liquid application unit related to a fourth embodiment.

According to the third embodiment, the liquid recovery port 59 is arranged below the liquid supply port 58 in terms of the vertical direction, and therefore, in the process of the recovery operation of the treatment liquid with respect to the liquid holding space S, nearly all the treatment liquid in the liquid holding space S can be recovered from the liquid recovery port 59. As a result, the evaporation and the leakage of remaining liquid (treatment liquid) in the liquid holding space S Fourth Embodiment FIG. 5 is a cross-sectional diagram illustrating main components of the treatment liquid application unit 16D related to a fourth embodiment. The elements that are common to the devices illustrated in FIGS. 2 and 5 are assigned to the same numbers, and the description thereof is omitted here.

As is the case of the third embodiment described above, in the treatment liquid application unit 16D related to the fourth embodiment, the liquid recovery port 59 is arranged below the liquid supply port 58 in terms of the vertical direction as illustrated in FIG. 5.

Further, in the fourth embodiment, a remaining liquid trap part 92 is provided so as to project downward in terms of the vertical direction beyond the contact surface with the application roller 50 on the rear side of the liquid holding space S (on the opposite side of the liquid holding space S from the application roller 50), and is connected to the liquid recovery port 59.

In the fourth embodiment, the remaining treatment liquid in the liquid holding space S is collected in the remaining liquid trap part 92 formed so as to project downward in terms of the vertical direction beyond the contact surface with the application roller 50. According to this structure, the treatment liquid existing in the vicinity of the lower end portion of the contact surface with the application roller 50 can be recovered, and thereby the remaining liquid can be recovered more reliably, compared to the third embodiment.

Fifth Embodiment

Next, a fifth embodiment, which is one of the best embodiments of the present invention, is described. The fifth embodiment is based on the combination of the second and fourth embodiments described above.

Figure 6:
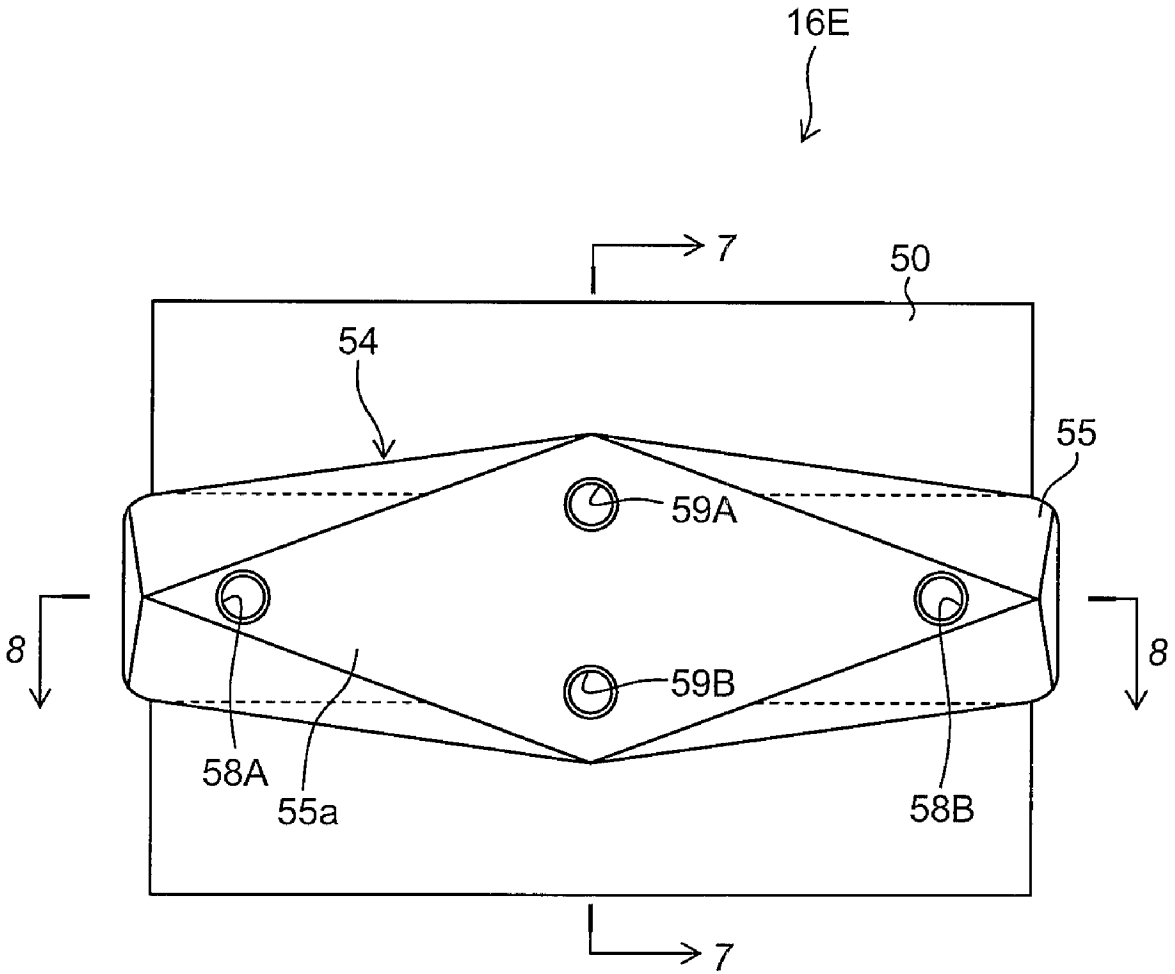
FIG. 6 is a cross-sectional diagram illustrating main components of a treatment liquid application unit related to a fifth embodiment.
Figure 7:
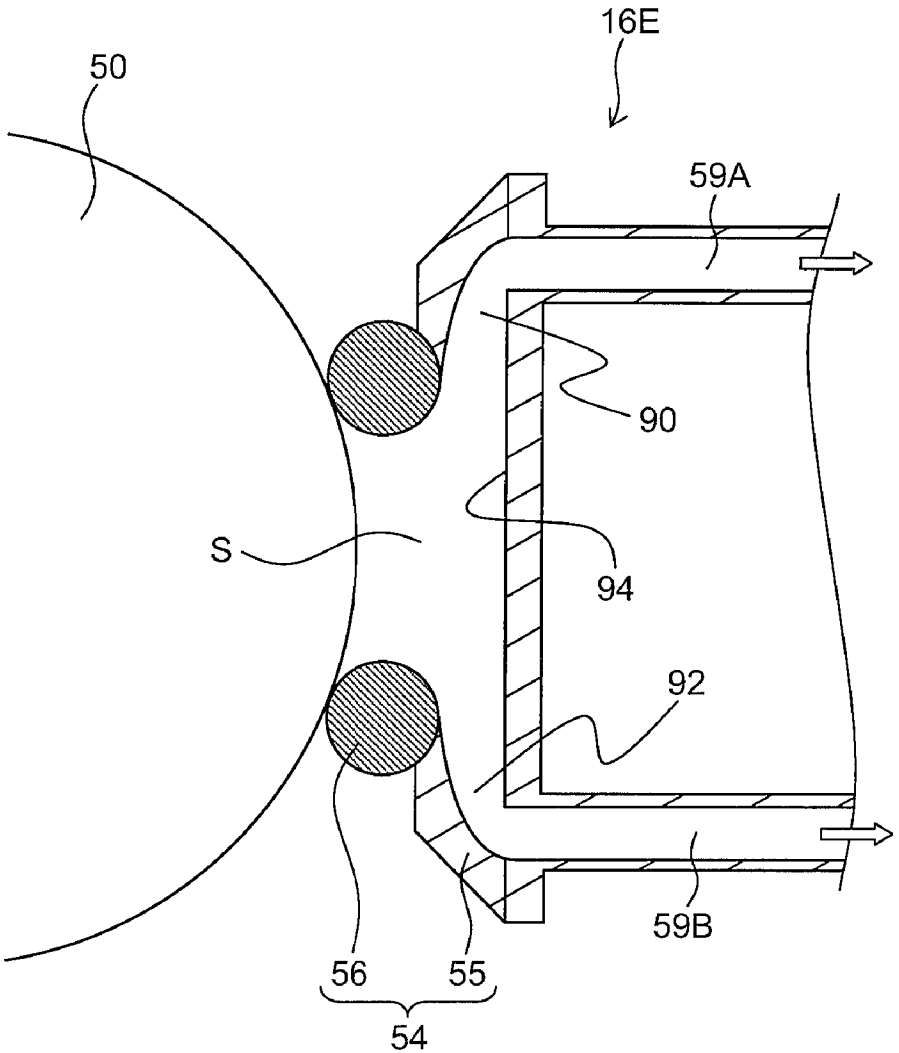
FIG. 7 is a cross-sectional view along line 7-7 in FIG. 6.
Figure 8:
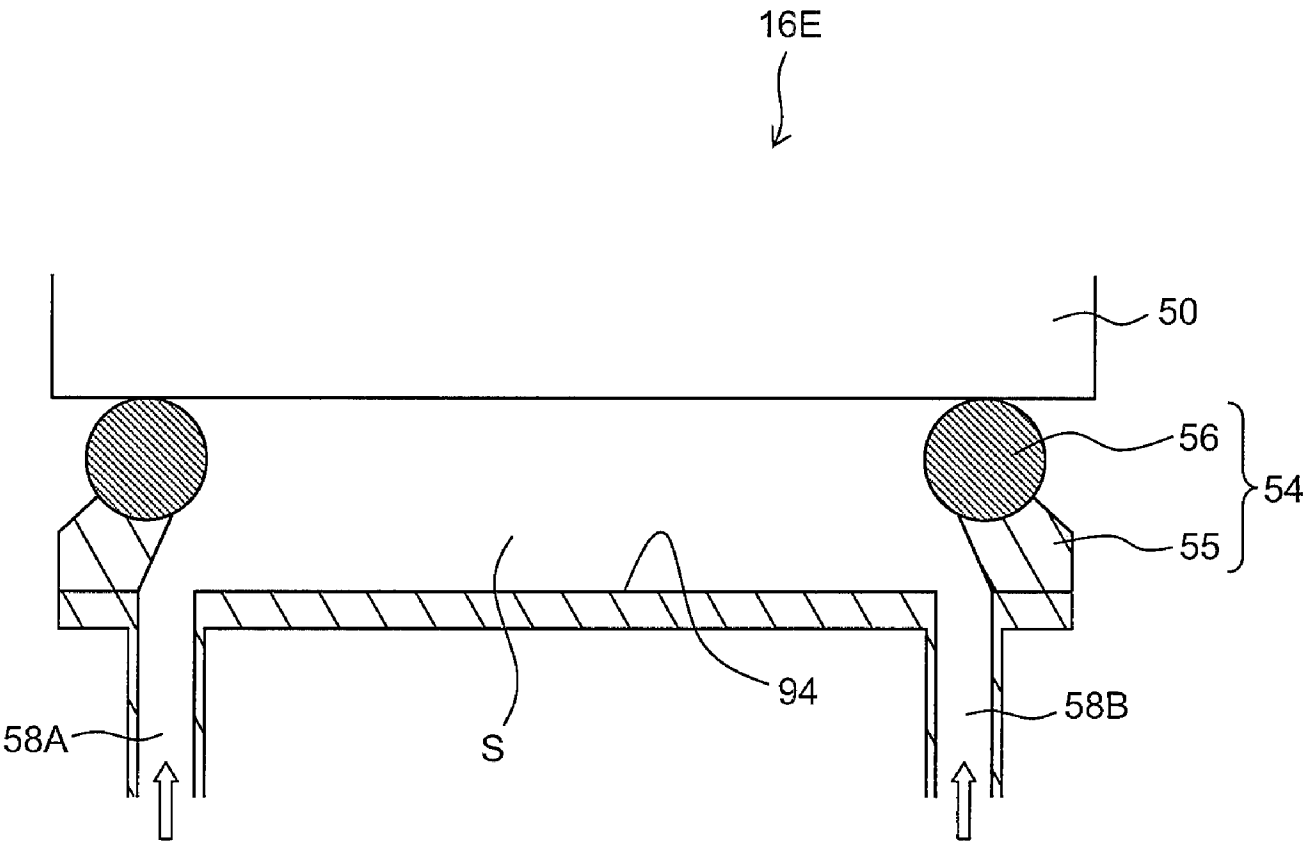
FIG. 8 is a cross-sectional view along line 8-8 in FIG. 6.

FIG. 6 is a rear view illustrating main components of the liquid application unit 16E related to the fifth Embodiment. FIG. 7 is a cross-sectional view along line 7-7 in FIG. 6. FIG. 8 is a cross-sectional view along the line 8-8 in FIG. 6. The elements that are common to the devices illustrated in FIGS. 2 and 6-8 are assigned to the same numbers, and the description thereof is omitted here.

As illustrated in FIGS. 6-8, the liquid holding member 54 of the treatment liquid unit 16E related the fifth embodiment includes: a space forming base member 55 which is a polyhedron structure having a planar shape of a rectangle shape on the front side (on the application roller side) and having a planar shape of a rhombic on the rear side (on the spring member side); and a circular abutment member 56 which is provided on and projects from one surface (the front surface) of the space forming base member 55.

On the rear side of the liquid holding space S (on the opposite side of the liquid holding space S from the application roller 50) formed by the abutment member 56 of the liquid holding member 54 being pressed against and abutting against (closely contacting with) the circumferential surface of the application roller 50, an air bubble trap part 90 is provided so as to project upward in terms of the vertical direction beyond the contact surface with the application roller 50, and a remaining liquid trap part 92 is provided so as to project downward in terms of the vertical direction beyond the contact surface with the application roller 50.

On the rear side of the space forming base member 55, liquid supply ports 58A and 58B and liquid recovery ports 59A and 59B each pass through the space forming base member 55 so as to connect with the liquid holding space S.

To put the arrangement relationship of these members (58A, 58B, 59A, 59B) more clearly, in the rhombic rear surface part 55*a* of the space forming base member 55, the liquid supply ports 58A and 58B are provided respectively on the opposite corners of the diagonal line in the longitudinal direction (the left corner and the right corner in FIG. 6), and the liquid recovery ports 59A and 59B are provided respectively on the opposite corners of the diagonal line in the short line direction which is perpendicular to the longitudinal direction (the upper corner and the lower corner in FIG. 6). In other words, the liquid supply ports 58A and 58B are located on the same level in terms of the vertical direction (i.e., the liquid supply ports 58A and 58B have a horizontally positional relationship), and in the central portion (central position) of these, the liquid recovery ports 59A and 59B are arranged with a prescribed interval in terms of the vertical direction.

The first liquid recovery port 59A is arranged above the liquid supply ports 58A and 58B in terms of the vertical direction, and passes through the space forming base member 55 so as to connect with the air bubble trap part 90.

The second liquid recovery port 59B is arranged below the liquid supply ports 58A and 58B in terms of the vertical direction, and passes through the space forming base member 55 so as to connect with the remaining liquid trap part 92.

By supplying the treatment liquid to the liquid holding space S via the liquid supply ports 58A and 58B by means of the liquid supply apparatus described hereinafter while causing the treatment liquid to flow out via the liquid recovery ports 59A and 59B, the circulation of the treatment liquid in the liquid holding space S is carried out.

The interior wall surface 94 of the liquid holding space S, in which the liquid supply ports 58A and 58B and the liquid recovery ports 59A and 59B are open, is constituted by a flat surface that does not have projecting portions and recess portions, and therefore the treatment liquid can be circulated in the liquid holding space S in a smooth manner. Further, an air bubble can be discharged without staying in the liquid holding space S In the fifth embodiment, the first liquid recovery port 59A is arranged above the liquid supply ports 58A and 58B in terms of the vertical direction, the second liquid recovery port 59B is arranged below the liquid supply ports 58A and 58B in terms of the vertical direction, the liquid recovery ports 59A and 59B are provided to connect with the air bubble trap part 90 and the remaining liquid trap part 92 formed in the liquid holding space S, and therefore, it is possible to discharge an air bubble existing in the liquid holding space S and recover the treatment liquid in an easier and more reliable fashion.

Further, as described above, in the space forming base member 55, the liquid supply ports 58A and 58B are provided respectively on the opposite corners of the diagonal line in the longitudinal direction, and the liquid recovery ports 59A and 59B are provided respectively on the opposite corners of the diagonal line in the short line direction perpendicular to the longitudinal direction. Therefore, the flow of the treatment liquid in the liquid holding space S from the liquid supply ports 58A and 58B toward the liquid recovery ports 59A and 59B is symmetrized, the circulation of the treatment liquid in the liquid holding space S is uniformized, and application failures such as unevenness of application can be prevented.

The number of, the shape of, and the size of the liquid supply ports and liquid recovery ports are not limited in particular, and may be determined properly in accordance with the application volume or application speed of the treatment liquid with respect to media onto which the liquid is applied (recording media).

Next, the structure of a liquid supply device supplying the treatment liquid to the liquid holding member 54 is described. Here, the structure of a liquid supply apparatus based on the fifth embodiment, which is one of the most preferable aspects of the embodiments described above, is described as an example.

Figure 9:
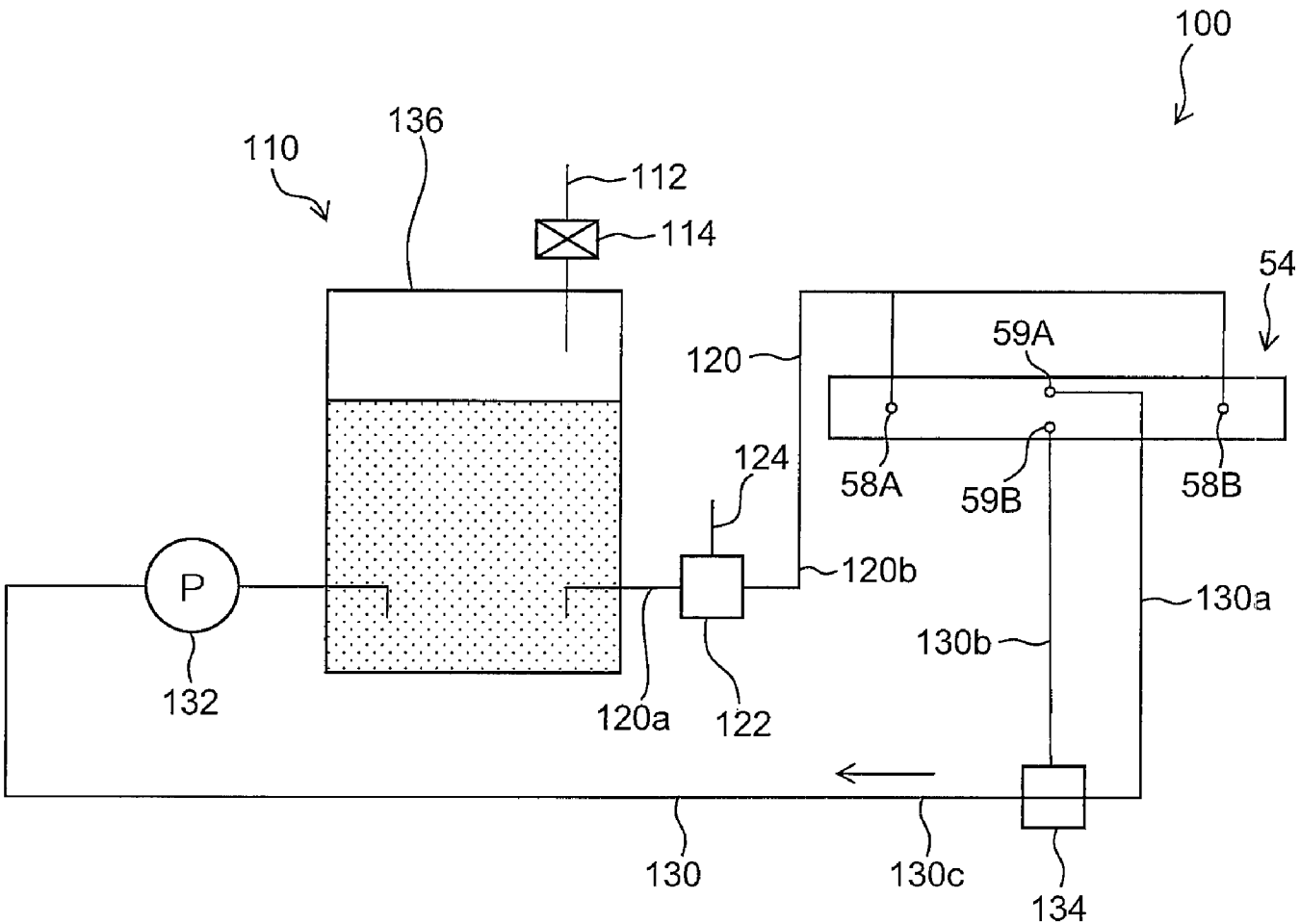
FIG. 9 is a schematic diagram illustrating a structural example of a liquid supply apparatus according to the fifth embodiment

FIG. 9 is a schematic diagram illustrating a structural example of a liquid supply apparatus according to the fifth embodiment. As illustrated in FIG. 9, this liquid supply apparatus 100 comprises a storage tank 110 which stores the treatment liquid, a supply flow channel 120 for supplying the treatment liquid to the liquid supply port 58A, 58B of the liquid holding member 54 from the storage tank 110, and a return flow channel (recovery flow channel) 130 for returning the treatment liquid to the storage tank 110 from the liquid return port 59A, 59B of the liquid holding member 54.

An air connection port 112 is provided in the storage tank 110, and an air connection valve 114 which switches between connecting to and shutting off the air is provided in the air connection port 112.

One end of the supply flow channel 120 branches into two channels which connect respectively with the liquid supply ports 58A and 58B of the liquid holding member 54. Further, the other end of the supply flow channel 120 connects with the storing tank 110, the opening section thereof is arranged in the bottom part of the storing tank 110 (or at a position in the vicinity thereof) in such a manner that the treatment liquid in the storing tank 110 can be used completely.

A supply three-way valve 122 is provided in the supply flow channel 120. This supply three-way valve 122 has three ports which are mutually connected, and two of these ports can be connected selectively to any two of the storage tank side flow channel 120*a* of the supply flow channel 120, the liquid holding member side flow channel 120*b* of the supply flow channel 120, and the air connection port 124. By switching this supply three-way valve 122, it is possible to switch selectively between a connected state where the storage tank side flow channel 120*a* and the liquid holding member side flow channel 120*b* are connected (hereinafter, simply called a "connected state") and a connected state where the liquid holding member side flow channel 120*b* and the air connection port 124 are connected (hereinafter called an "air connected state"), and thereby it is possible to supply either the treatment liquid inside the storage tank 110 or air taken in via the air connection port 124, to the liquid holding space S formed by the liquid holding member 54 and the application roller 50.

The recovery channel 130 includes a first recovery channel 130*a* and a second recovery channel 130*b* connected respectively to the liquid recovery ports 59A and 59B of the liquid holding member 54, and a third recovery channel 130*c* connected to the storing tank 110. In the third recovery channel 130*c*, a pump 132 generating a flow force that forcibly causes liquid and/or air to flow in the direction indicated by the arrow in FIG. 9 is provided.

The recovery channels 130*a*, 130*b*, 130*c* are connected to a recovery three-way valve 134. This recovery three-way valve 134 has a similar structure to the supply three-way valve 122 provided in the supply flow channel 120. More specifically, the recovery three-way valve 134 has three ports that are connected to each other, and can selectively connect two of these ports to two of the first recovery channel 130*a*, the second recovery channel 130*b* and the third recovery channel 130*c*. Then, by switch this recovery three-way valve 134 appropriately, the connection is selectively switched between the connection state where the first recovery channel 130*a* is connected to the third recovery channel 130*c* and the connection state where the second recovery channel 130*b* is connected to the third recovery channel 130*c*. According to this structure, the treatment liquid in the liquid holding space S formed by the liquid holding member 54 and the application roller 50 or air (bubbles) existing in the liquid holding space S can be sent to the storing tank 110 and recovered.

For the material of tubes constituting the supply flow channel 120 and the recovery channel 130, for example, polypropylene, polyethylene-chlorofluoroethylene, polyethylene-tetrafluoroethylene, ethylene-polyvinyl acetate resin, polyethylene-vinyl alcohol, polytetrafluoroethylene hexafluoropropylene, polystyrene, polyethylene, nylon, polyethylene terephthalate, polyamidc, polyamide-imide, polyarylate, polycarbonate, polytrifluoroethylene, polyether ether ketone, polyethylene naphthalate, polyetherimide, poly ether sulphone, polyimide, tetrafluoroethylene perfluoroalkyl vinyl ether, polyparabanic acid, polyphenylene sulfide, polysulfone, polytetrafluoroethylene, polyvinyl acetate, polyvinyl chloride, polyvinyl fluoride, polyvinylidene chloride (PVDC), polyvinylidene-fluoride, polybutylene terephthalate, ionomer resin, polyacrylonitrile (PAN), polyester, polymethylmethacrylate, polyurethane, polybutadiene, polytetramethylpentene, acetylcellulose resin, ethylcellulose resin, polyvinyl alcohol, polylactate, ABS (acrylonitrile butadiene styrene) and the like can be used.

Of these, polyvinylidene chloride (PVDC), ethylene-vinylalcohol copolymer (EVOH) and polyacrylonitrile (PAN) can be desirably used from the viewpoint of the gas barrier property.

Further, metal tubes, materials with evaporated metals, films of mica oriented in the shape of thin-flat plate can be effectively used.

Figure 10:
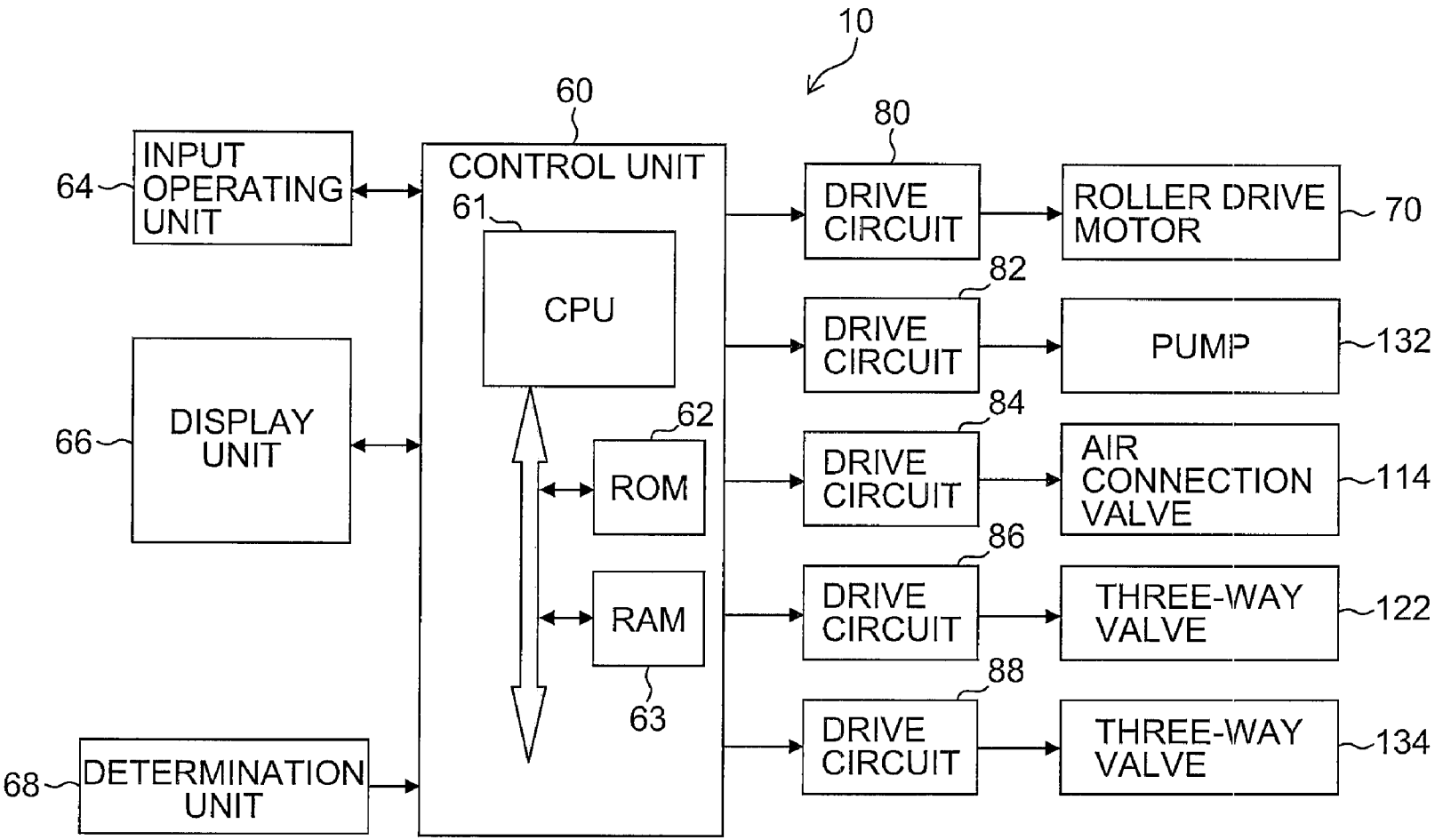
FIG. 10 is a block diagram illustrating configuration of the control system of an inkjet recording apparatus.

FIG. 10 is a block diagram illustrating the composition of the control system of an inkjet recording apparatus 10 according to the present embodiment.

In FIG. 10, the control section 60 (which is equivalent to a "drive control device") is a control device which performs overall control of the whole of the inkjet recording apparatus 10. The control unit 60 comprises: a CPU (Central Processing Unit) 61 which executes processing of various types in accordance with prescribed programs; a ROM (Read Only Memory) 62 which stores programs, data of various types, and the like; and a RAM (Random Access Memory) 63 which temporarily stores data, and the like, that are used in the various types of processing.

The input operating unit 64 is constituted, for example, by a keyboard or mouse (or various switches, or the like) which is used to input prescribed instructions or data. The display unit 66 constitutes a user interface together with the input operating unit 64 and provides various displays in conjunction with the control unit 60. For example, the display unit 66 is constituted by a liquid display apparatus.

Furthermore, the inkjet recording apparatus 10 comprises a determination unit 68 which includes a sensor (medium size determination sensor) for determining the width size of the recording medium 12 (see FIG. 1) (the size in the breadthways direction which is perpendicular to the medium conveyance direction), a sensor (medium position determination sensor) for determining the position of the medium, and in addition to these, a sensor which determines the operational states of the respective units, and the like. The signals from the determination unit 68 are sent to the control unit 60, and are used to drive the roller and control other operations. The determination unit 68 includes the medium leading edge determination sensors 32, 34.

Furthermore, the inkjet recording apparatus 10 comprises a roller drive motor 70 which drives the application roller 50 (see FIG. 1), the pump 132 (see FIG. 9), the air connection valve 114, the supply three-way valve 122, the recovery three-way valve 134 and drive circuits 80, 82, 84, 86 and 88 corresponding to these respective elements; and the control unit 60 sends control signals to the respective drive circuits 80 to 88 in accordance with programs, and thereby controls the operation of the respective elements.

Figure 11:
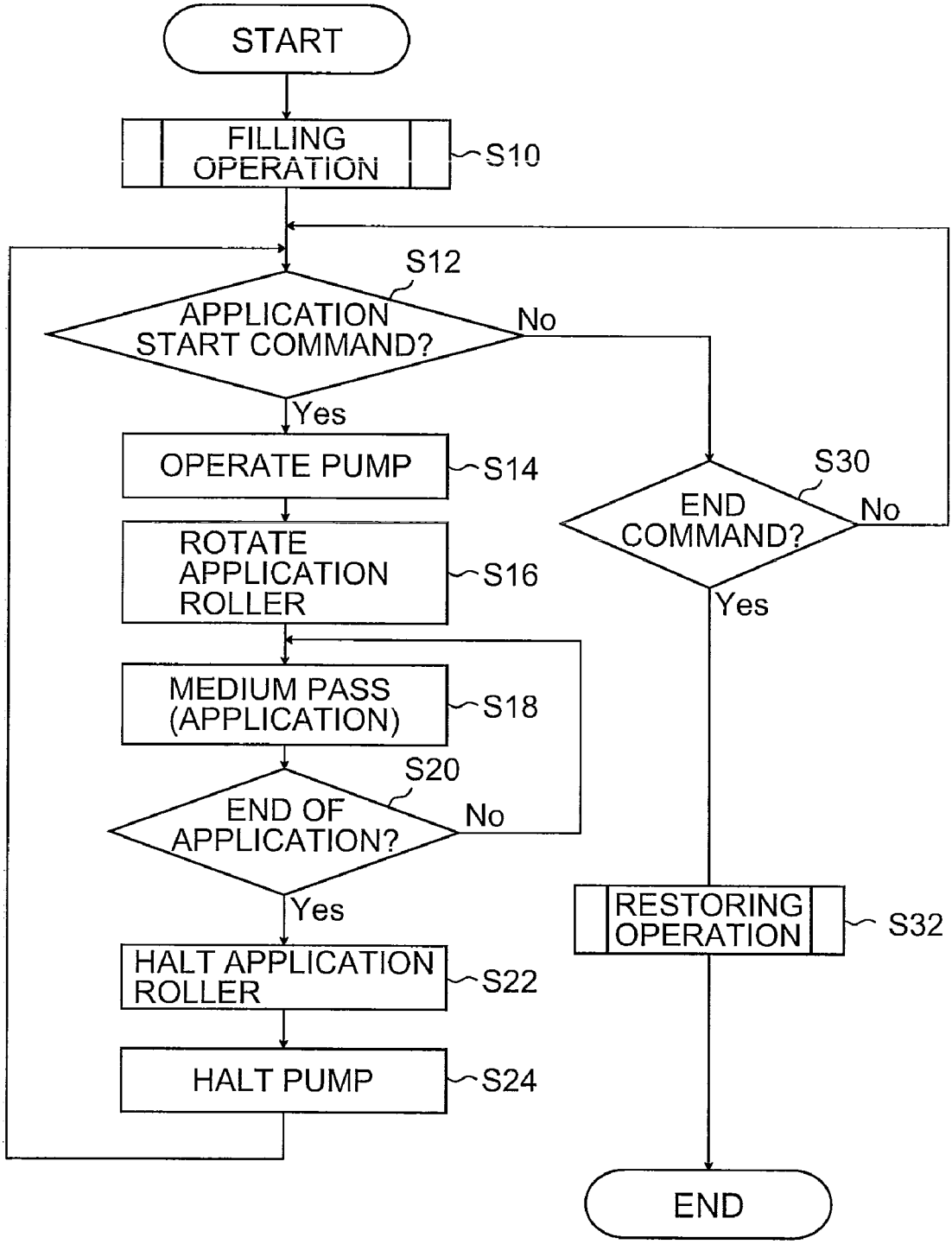
FIG. 11 is a flowchart illustrating an operational sequence of an inkjet recording apparatus.

FIG. 11 is a flowchart illustrating the operational sequence of the inkjet recording apparatus 10. These operations are executed in accordance with programs, under the control of the control unit 60 illustrated in FIG. 10. In the initial state at the start of this sequence, it is supposed that the liquid holding space S and the flow channels 120 and 130 are not filled with the treatment liquid.

Firstly, when the power supply of the liquid application apparatus is switched on, the filling operation (supply operation) for filling the treatment liquid into the liquid holding space S is carried out (step S10).

During this filling operation, the pump 132 is driven over a certain period of time, while the air connection valve 114 of the storing tank 110 is opened, the supply three-way valve 122 is switched so as to ensure the connecting state of the supply flow channel 120 (where the storing tank side flow channel 120*a* is connected to the liquid holding member side flow channel 120*b*), and furthermore the recovery three-way valve 134 is switched so as to connect the second recovery flow channel 130*b* to the third recovery flow channel 130*c*.

Further, at the timing when the second recovery flow channel 130*b* is filled with the treatment liquid (or at the timing after the second recovery flow channel 130*b* has been filled with the treatment liquid), the pump 132 is driven over a certain period of time while the first recovery flow channel 130*a* is connected to the third recovery flow channel 130*c* by switching the recovery three-way valve 134.

As a result of this operation, as illustrated in FIG. 7, since the first liquid recovery port 59A to be connected to the first recovery flow channel 130*a* is connected to the air bubble trap part 90 provided in the upper part of the liquid holding space S in terms of the vertical direction, air existing in the flow channels 120, 130 including the liquid holding space S is sent to the storing tank 110 and then discharged into the atmosphere from the storing tank 110, without air bubbles remaining in the liquid holding space S.

The driving time of the pump 132 and the switching timing of the recovery three-way valve 134 are set on the basis of the time until the treatment liquid is filled with each part (in other words, the time until the air existing in each part is completely discharged).

In this way, the treatment liquid is filled into the liquid holding space S and each part of the flow channels 120 and 130 (130*a*-130*c*), and a state is assumed whereby the treatment liquid can be supplied to the application roller 50 which is in contact with the liquid holding space S.

After the filling operation has been carried out in this way, the presence or absence of an application start command is judged (step S12 in FIG. 6). An application start command signal is issued in coordination with the conveyance of the recording medium 12. The application start command signal is issued at a prescribed time differential in such a manner that the application of treatment liquid starts at the timing that the recording medium 12 arrives at the nip section between the application roller 50 and the counter roller 52.

When the application start command is input and a Yes verdict is obtained at step S12, then the pump 132 is operated (step S14), and furthermore the roller driving is started to rotate the application roller 50 in the clockwise direction in FIG. 1 (step S16).

By this means, the treatment liquid held in the liquid holding space S is impelled by the pressing force of the abutting member 56 of the liquid holding member 54 against the application roller 50, and thereby a layer of treatment liquid is formed on the outer circumferential surface of the application roller 50. The treatment liquid which has adhered to the outer circumferential surface of the application roller 50 is supplied to the abutting section with the counter roller 52 due to the rotation of the application roller 50.

Thereupon, the recording medium 12 is conveyed between the application roller 50 and the counter roller 52 by the medium conveyance mechanism, the recording medium 12 is introduced between the rollers 50 and 52, and furthermore the recording medium 12 is conveyed toward the paper output unit due to the rotation of the application roller 50 and the counter roller 52. The treatment liquid which has been applied to the outer circumferential surface of the application roller 50 is transferred to the recording medium 12 during this conveyance process (step S18).

Figure 12:
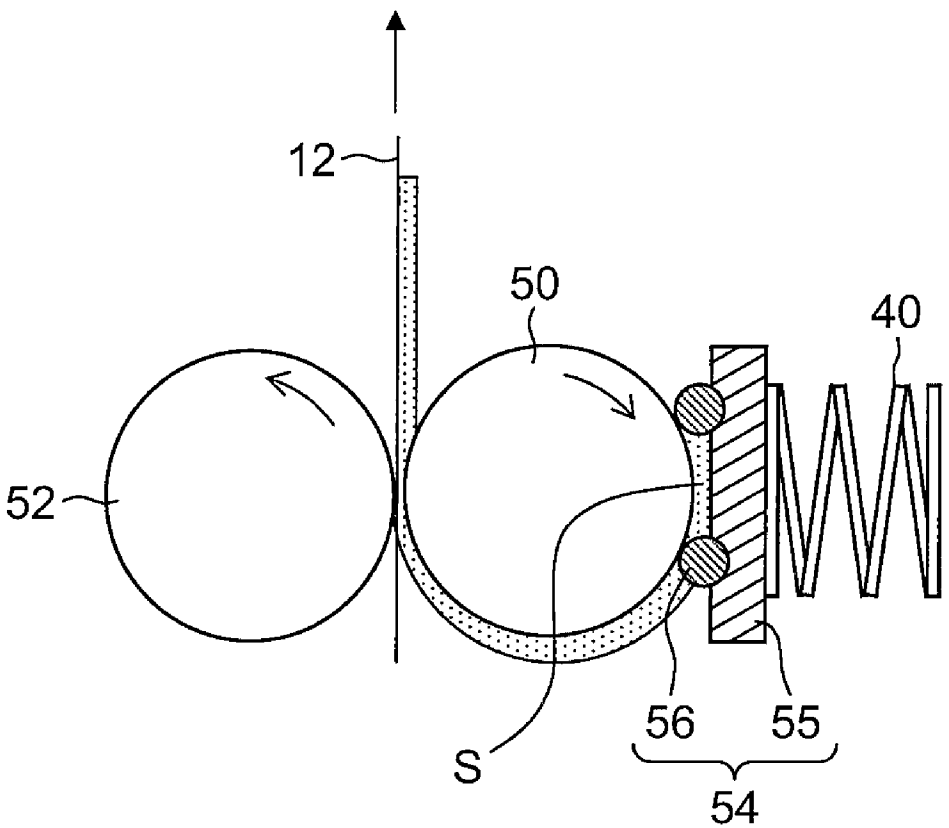
FIG. 12 is an explanatory diagram illustrating an application step of treatment liquid.
Figure 13:
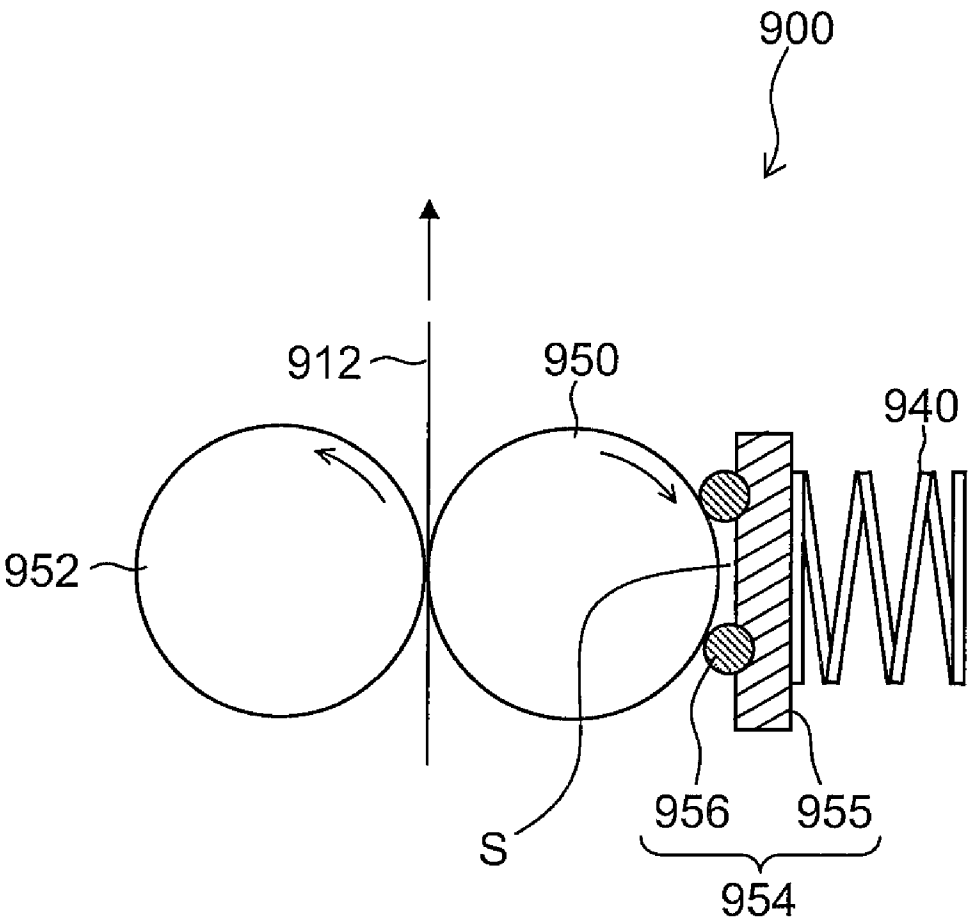
FIG.13 RELATED ART
FIG. 13 is a cross-sectional view illustrating main structure of a general liquid application apparatus according to the related art.
Figure 14:
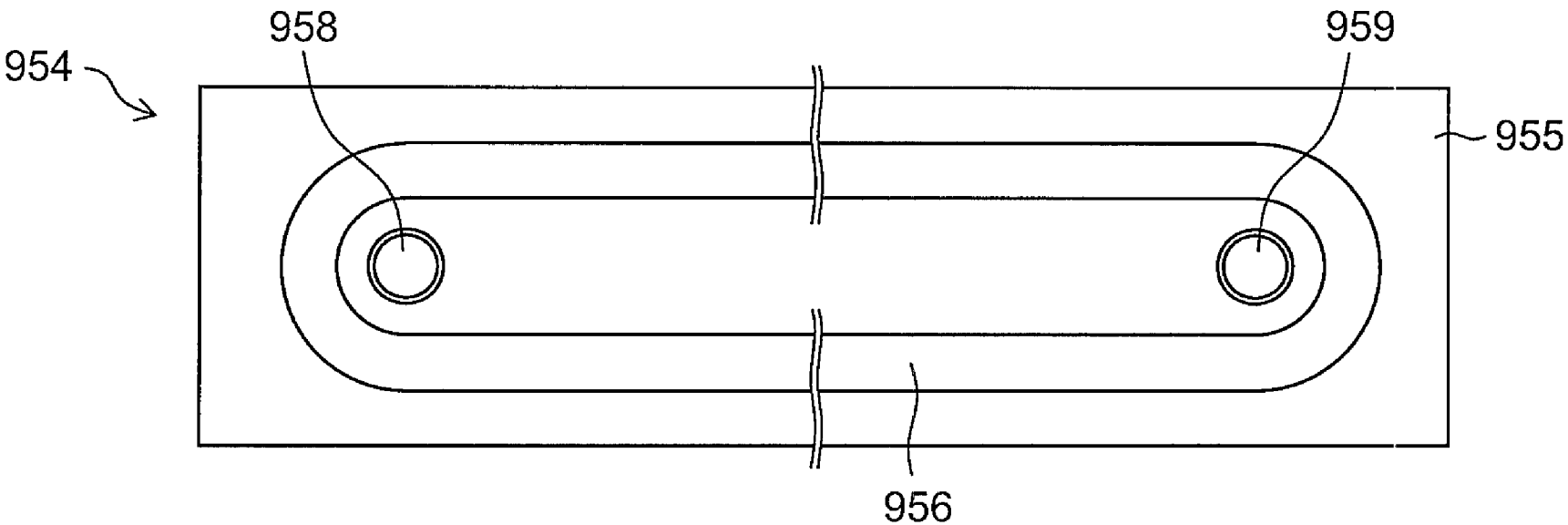
FIG.14 RELATED ART
FIG. 14 is a plan view illustrating a liquid holding member included in the liquid application apparatus illustrated in FIG. 13.
Figure 15:
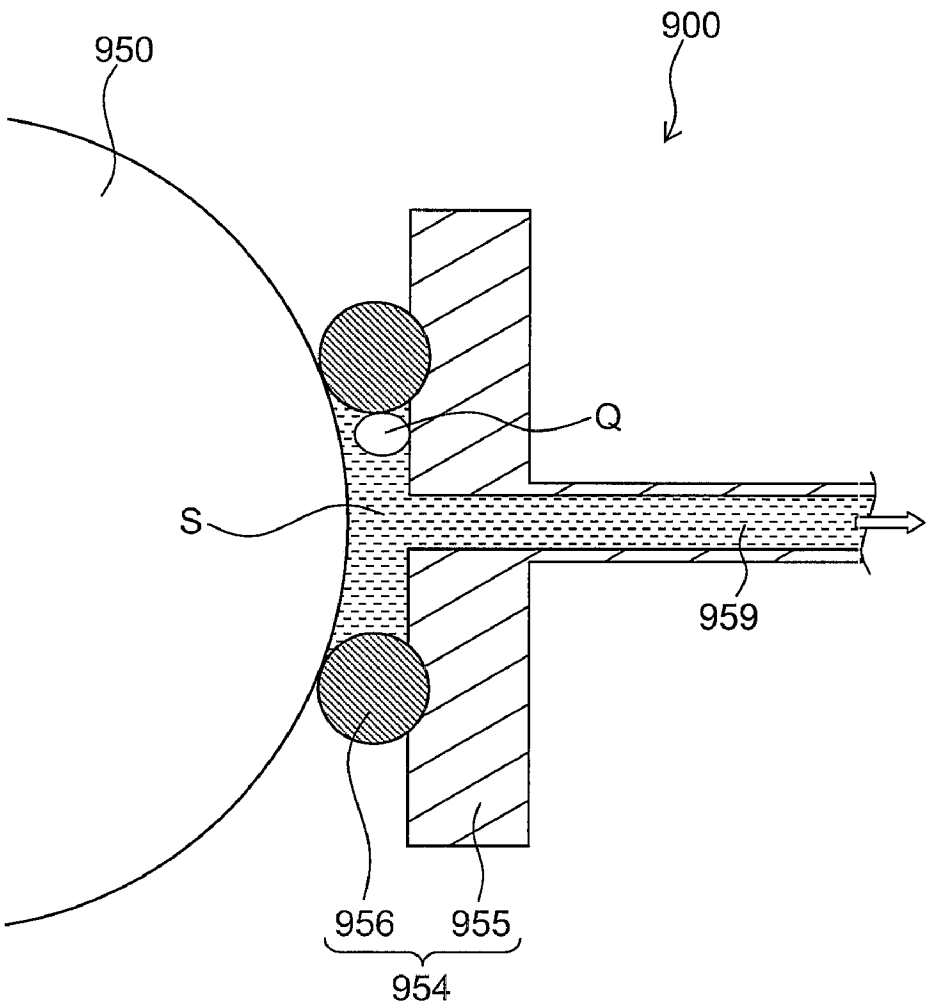
FIG.15 RELATED ART
FIG. 15 is an explanatory diagram illustrating a state where an air bubble remains in a liquid holding space.
Figure 16:
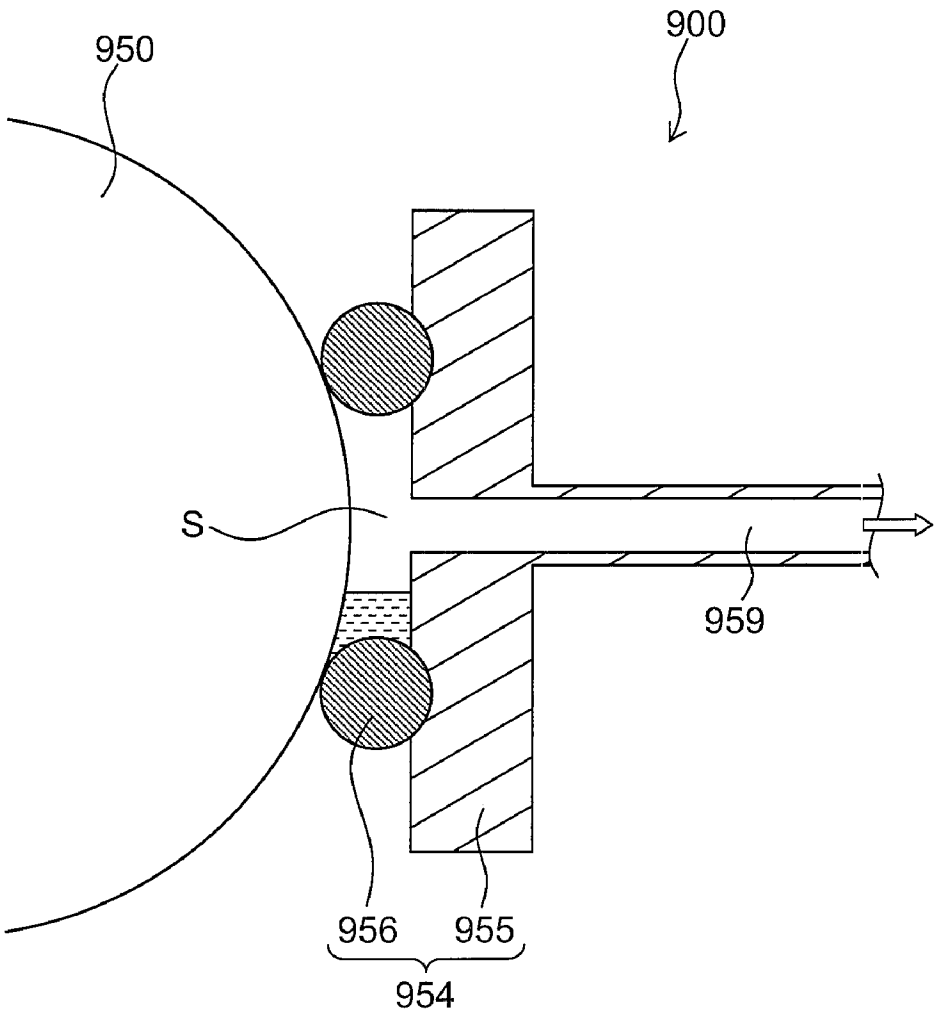
FIG.16 RELATED ART
FIG. 16 is an explanatory diagram illustrating a state where treatment liquid remains in the liquid holding space.

FIG. 12 illustrates an aspect of the application step in step S18. The thickness of the treatment liquid layer in FIG. 12 is depicted in an exaggerated fashion to be much larger than its actual size ratio. As illustrated in FIG. 12, the recording medium 12 which is sandwiched between the application roller 50 and the counter roller 52 is conveyed in the direction of the arrow in FIG. 12 due to the rotational force of the application roller 50, and furthermore the treatment liquid supplied to the outer circumferential surface of the application roller 50 is applied to the recording medium 12. In this way, treatment liquid of a uniform volume has been deposited onto the recording surface of the recording medium 12 which has passed between the application roller 50 and the counter roller 52.

In this embodiment, desirably, while the recovery three-way valve 134 is switched so as to connect the first recovery flow channel 130*a* with the third recovery flow channel 130*c*, the application operation is carried out. Since the first liquid recovery port 59A to be connected to the first recovery flow channel 130*a* is connected to the air bubble trap part 90 provided in the upper part of the liquid holding space S in terms of the vertical direction, then air bubbles can be discharged without leaving such air bubbles in the liquid holding space S and it is possible to prevent application failures caused by air bubbles.

In order to improve the transfer characteristics of the treatment liquid from the application roller 50 to the recording medium 12, it is desirable that the surface free energy of the application roller 50 should be lower than the surface free energy of the recording medium 12. In other words, a material which satisfies the inequality relationship indicated in Formula (1) below is employed as the surface member of the application roller 50.

$$\text{Surface free energy of application roller} < \text{Surface free energy of recording medium} \qquad \text{Formula (1)}$$

When the application operation onto the recording medium 12 described above has been carried out, the control unit 60 judges the end timing of the application operation (step S20 in FIG. 11). If liquid is applied to the whole surface of the recording medium 12, then the judgment at step S20 produces a No verdict and returns to step S18, until the recording medium 12 has passed completely.

If it is judged that the application step in the required application range has been completed (Yes verdict at step S20), for instance, the timing of the passage of the trailing edge of the recording medium 12 is detected or the end of a job of a specified number of sheets is detected, then the application roller 50 is halted (step S22), the pump 132 is halted (step S24) and the procedure returns to step S12.

The surface of the counter roller 52 has high lyophobic properties, by means of a fluorine coating for example, and is composed in such a manner that treatment liquid does not become attached readily to the surface of the counter roller 52 due to contact between the application roller 50 and the counter roller 52. By suitably designing the relationship of the free surface energy between the surface members of the both rollers, it is possible to prevent treatment liquid from becoming attached to the counter roller 52. Furthermore, a desirable mode is one in which a movement mechanism which is capable of altering the relative distance between the application roller 50 and the counter roller 52 is provided in at least one of the application roller 50 and the counter roller 52, and if it is judged that the application operation has been completed at step S20, then the adherence of treatment liquid to the surface of the counter roller 52 is prevented by setting the rollers to a mutually separated state.

At step S12, if a new application start command is input, then the processing in step S14 to step S24 described above is repeated. On the other hand, if at step S12 the application start command has not been input, then the procedure advances to step S30, and it is judged whether or not there is an application end command (step S30). The end command may be issued in accordance with various modes, such as a mode where an end command is issued automatically when a specified wait time has elapsed on the basis of time management using a timer, or the like, a mode where an end command is issued when application onto a specified number of sheets of media has been completed, a mode based on an operation from the input operating unit 64, or a mode based on a switching off operation of the apparatus power supply, or the like.

If an end command has not been input, then the procedure returns to step S12. If an end command has been input at step S30, then the return operation (restoring operation) of returning (restoring) the treatment liquid inside the liquid holding space S is carried out (step S32).

During this recovery operation, the pump 132 is driven over a certain period of time, while the air connection valve 114 of the storing tank 110 is opened, the supply three-way valve 122 is switched so as to put the supply flow channel 120 into the open-air state (where the liquid holding member side flow channel 120*b* is connected with the air connecting port 124) and the recovery three-way valve 134 is switched so as to connect the first recovery flow channel 130*a* with the third recovery flow channel 130*c*.

Further, at the timing when the treatment liquid in the first recovery flow channel 130*a* has been recovered (or at the timing after the treatment liquid in the first recovery flow channel 130*a* has been), the pump 132 is driven over a certain period of time while the second recovery flow channel 130*b* is connected with the third recovery flow channel 130*c* by switching the recovery three-way valve 134.

As a result of this operation, as illustrated in FIG. 7, since the second liquid recovery port 59B to be connected with the second recovery flow channel 130*b* is connected with the remaining liquid trap part 92 provided in the lower part of the liquid holding space S in terms of the vertical direction, the treatment liquid existing in the flow channels 120, 130 including the liquid holding space S is sent to the storing tank 110 and each part is filled with air introduced via the air connecting port 124, without the treatment liquid remaining in the liquid holding space S.

The driving time of the pump 132 and the switching timing of the recovery three-way valve 134 are set on the basis of the time until the treatment liquid in each part is completely recovered (in other words, the time until each part is filled with the air).

After the return operation (after the recovery operation), the air connection valve 114 is closed, the supply three-way valve 122 is switched so as to set the liquid holding member side flow channel 120*b* and the air connection port 124 to a connected state, and the storage tank 110 is shut off from the air, thereby preventing evaporation and outflow of liquid.

The embodiments described above relate to an example of application to an inkjet recording apparatus for printing, but the scope of application of the present invention is not limited to the embodiments. For instance, it can also be applied widely to other apparatuses which obtain various shapes and patterns by using a liquid functional material, such as a wiring printing apparatus which prints a wiring pattern for an electronic circuit, and a fine structure forming apparatus which forms a fine structure by using a material deposition substance.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid application apparatus comprising:

an application member which applies a first liquid to a recording medium; and a liquid holding member which abuts against the application member so as to form a liquid holding space in which the first liquid is held in such a manner that the first liquid held in the liquid holding space is applied to the recording medium via the application member by rotating the application member, wherein:

a supply port for supplying the first liquid in the liquid holding space and a first recovery port for recovering the first liquid from the liquid holding space are provided in the liquid holding member;

the first recovery port is arranged above the supply port in terms of vertical direction;

a bubble trap part is provided in the liquid holding space so as to extend above a contact surface between the application member and the liquid holding space in terms of the vertical direction; and the first recovery port is connected to the bubble trap part at an uppermost part of the bubble trap part in terms of the vertical direction.

2. The liquid application apparatus as defined in claim 1, wherein, in the liquid holding member, a second recovery port is provided below the supply port in terms of the vertical direction.

3. The liquid application apparatus as defined in claim 2, wherein:

in the liquid holding space, a remaining liquid trap part is provided so as to extend below the contact surface between the application member and the liquid holding space in terms of the vertical direction; and the second recovery port is connected to the remaining liquid trap part.

4. The liquid application apparatus as defined in claim 2, further comprising:

a liquid storing device which stores the first liquid recovered from the liquid holding space;

a first recovery flow channel connected to the first recovery port;

a second recovery flow channel connected to the second recovery port;

a third recovery flow channel connected to the liquid storing device; and a flow channel switching device which is connected to the first to third recovery flow channels and selectively switches between a state where the first recovery flow channel is connected to the third recovery flow channel and a state where the second recovery flow channel is connected to the third recovery flow channel.

5. The liquid application apparatus as defined in claim 4, further comprising a first controller which controls the flow channel switching device in such a manner that the first recovery flow channel is connected to the third recovery flow channel while the application member applies the first liquid to the recording medium.

6. The liquid application apparatus as defined in claim 4, further comprising a second controller which controls the flow channel switching device in such a manner that, when a liquid filling operation in which the liquid holding space is filled with the first liquid is carried out, the first recovery flow channel is connected to the third recovery flow channel at least in a final stage of the liquid filling operation.

7. The liquid application apparatus as defined in claim 4, further comprising a third controller which controls the flow channel switching device in such a manner that, when a liquid recovery operation in which the first liquid is recovered from the liquid holding space is carried out, the second recovery flow channel is connected to the third recovery flow channel at least in a final stage of the liquid recovery operation.

8. An image forming apparatus comprising:

the liquid application apparatus as defined in claim 1; and a liquid ejection device which ejects a second liquid onto the recording medium to which the liquid application device has applied the first liquid.

9. The image forming apparatus as defined in claim 8, wherein the second liquid is an ink containing a color material, and the first liquid is a treatment liquid having a property of aggregating the color material.

10. A liquid application method using a liquid application apparatus, wherein the liquid application apparatus includes:

an application member which applies a first liquid to a recording medium;

a liquid holding member which abuts against the application member so as to form a liquid holding space in which the first liquid is held in such a manner that the first liquid held in the liquid holding space is applied to the recording medium via the application member by rotating the application member;

a supply port which is provided in the liquid holding member and supplies the first liquid in the liquid holding space, and a first recovery port and a second recovery port which are provided in the liquid holding member and recover the first liquid from the liquid holding space, the first recovery port being located above the supply port in terms of vertical direction, the second recovery port being located below the supply port in terms of the vertical direction;

a bubble trap part which is provided in the liquid holding space so as to extend above a contact surface between the application member and the liquid holding space in terms of the vertical direction, the first recovery port being connected to the bubble trap part at an uppermost part of the bubble trap part in terms of the vertical direction;

a liquid storing device which stores the first liquid recovered from the liquid holding space;

a first recovery flow channel connected to the first recovery port;

a second recovery flow channel connected to the second recovery port;

a third recovery flow channel connected to the liquid storing device; and a flow channel switching device which is connected to the first to third recovery flow channels and selectively switches between a state where the first recovery flow channel is connected to the third recovery flow channel and a state where the second recovery flow channel is connected to the third recovery flow channel, wherein the liquid application method comprising the step of applying the first liquid to the recording medium by the application member, and wherein, while the application member applies the first liquid to the recording medium, the flow channel switching device maintains the state where the first recovery flow channel is connected to the third recovery flow channel.

11. The liquid application method as defined in claim 10, wherein, when a liquid filling operation in which the liquid holding space is filled with the first liquid is carried out, the first recovery flow channel is connected to the third recovery flow channel at least in a final stage of the liquid filling operation.

12. The liquid application method as defined in claim 10, wherein, when a liquid recovery operation in which the first liquid is recovered from the liquid holding space is carried out, the second recovery flow channel is connected to the third recovery flow channel at least in a final stage of the liquid recovery operation.

* * * * *